US009070965B2

(12) United States Patent
Achour et al.

(10) Patent No.: US 9,070,965 B2
(45) **Date of Patent: *Jun. 30, 2015**

(54) HYBRID METAMATERIAL ANTENNA STRUCTURES

(75) Inventors: Maha Achour, Encinitas, CA (US); Ajay Gummalla, Sunnyvale, CA (US); Vaneet Pathak, San Diego, CA (US)

(73) Assignee: Tyco Electronics Services GmbH (CH)

( * ) Notice: Subject to any disclaimer, the term of this patent is extended or adjusted under 35 U.S.C. 154(b) by 385 days.

This patent is subject to a terminal disclaimer.

(21) Appl. No.: 13/040,496

(22) Filed: Mar. 4, 2011

(65) Prior Publication Data

US 2011/0273353 A1 Nov. 10, 2011

Related U.S. Application Data

(60) Provisional application No. 61/310,623, filed on Mar. 4, 2010, provisional application No. 61/332,620, filed on May 7, 2010, provisional application No. 61/366,520, filed on Jul. 21, 2010.

(51) Int. Cl.

| | |
|---|---|
| ***H01Q 9/04*** | (2006.01) |
| ***H01Q 1/00*** | (2006.01) |
| ***H01Q 5/00*** | (2015.01) |
| ***H01Q 1/38*** | (2006.01) |
| ***H01Q 15/00*** | (2006.01) |

(52) U.S. Cl.

CPC ..... *H01Q 5/0024* (2013.01); *H01Q 1/38* (2013.01); *H01Q 9/0428* (2013.01); *H01Q 15/006* (2013.01)

(58) Field of Classification Search

USPC ..... 343/700 MS, 702, 725, 893

See application file for complete search history.

(56) References Cited

U.S. PATENT DOCUMENTS

| | | | | |
|---|---|---|---|---|
| 7,119,746 | B2 * | 10/2006 | Luk et al. | 343/702 |
| 7,504,997 | B2 * | 3/2009 | Baliarda et al. | 343/700 MS |
| 7,592,957 | B2 | 9/2009 | Achour et al. | |
| 7,764,232 | B2 | 7/2010 | Achour et al. | |
| 8,299,967 | B2 | 10/2012 | Xu et al. | |
| 8,514,146 | B2 | 8/2013 | Gummalla et al. | |
| 2006/0256030 | A1 * | 11/2006 | Umehara | 343/895 |
| 2008/0048917 | A1 * | 2/2008 | Achour et al. | 343/700 MS |
| 2009/0135087 | A1 | 5/2009 | Gummalla et al. | |
| 2010/0123635 | A1 | 5/2010 | Lopez et al. | |
| 2012/0001826 | A1 | 1/2012 | Achour et al. | |

OTHER PUBLICATIONS

U.S. Appl. No. 13/039,964, Non Final Office Action mailed Apr. 17, 2013, 19 pgs.

"U.S. Appl. No. 13/039,964, Response filed Oct. 9, 2013 to Non-Final Office Action mailed Apr. 17, 2013", 10 pgs.

Caloz, C., et al., *Electromagnetic Metamaterials: Transmission Line Theory and Microwave Applications*, John Wiley & Sons, (2006), 186 pgs.

Itoh, T., "Invited Paper: Prospects for Metamaterials", *Electronics Letters* 40(16), (Aug. 2004), 972-973.

"U.S. Appl. No. 13/039,964, Final Office Action mailed Nov. 25, 2013", 22 pgs.

* cited by examiner

*Primary Examiner* — Robert Karacsony
*Assistant Examiner* — Patrick Holecek

(57) ABSTRACT

A wireless device having a CRLH antenna structure incorporates a meander line at the feed and adds a three dimensional conductive structure to shift a meander mode resonance frequency.

17 Claims, 5 Drawing Sheets

HYBRID METAMATERIAL ANTENNA STRUCTURES

PRIORITY CLAIMS AND RELATED APPLICATIONS

This application claims priority under 35 U.S.C. 119(e) to U.S. Provisional Patent Application Ser. No. 61/310,623, entitled "HYBRID METAMATERIAL ANTENNA STRUCTURES," filed on Mar. 4, 2010, to U.S. Provisional Patent Application Ser. No. 61/332,620, entitled HYBRID METAMATERIAL ANTENNA STRUCTURES," filed on May 7, 2010, and to U.S. Provisional Patent Application Ser. No. 61/366,520, entitled HYBRID METAMATERIAL ANTENNA STRUCTURES," filed on Jul. 21, 2010, which are incorporated herein by reference in their entireties.

BACKGROUND

The present invention relates to antenna devices based on Composite Right and Left Handed (CRLH) structures. Such CRLH structures may be used to build Radio Frequency (RF) components, such as antennas. The CRLH structures may be printed on a circuit board or built as discrete elements. The CRLH structures may be built on spare or unused space within a device design or layout. As the complexity of the device increases to accommodate additional functionality and components, and as the size of the device, such as a cellular communication device, decreases, the available space for the CRLH structures is reduced.

DESCRIPTION

Figure 1:
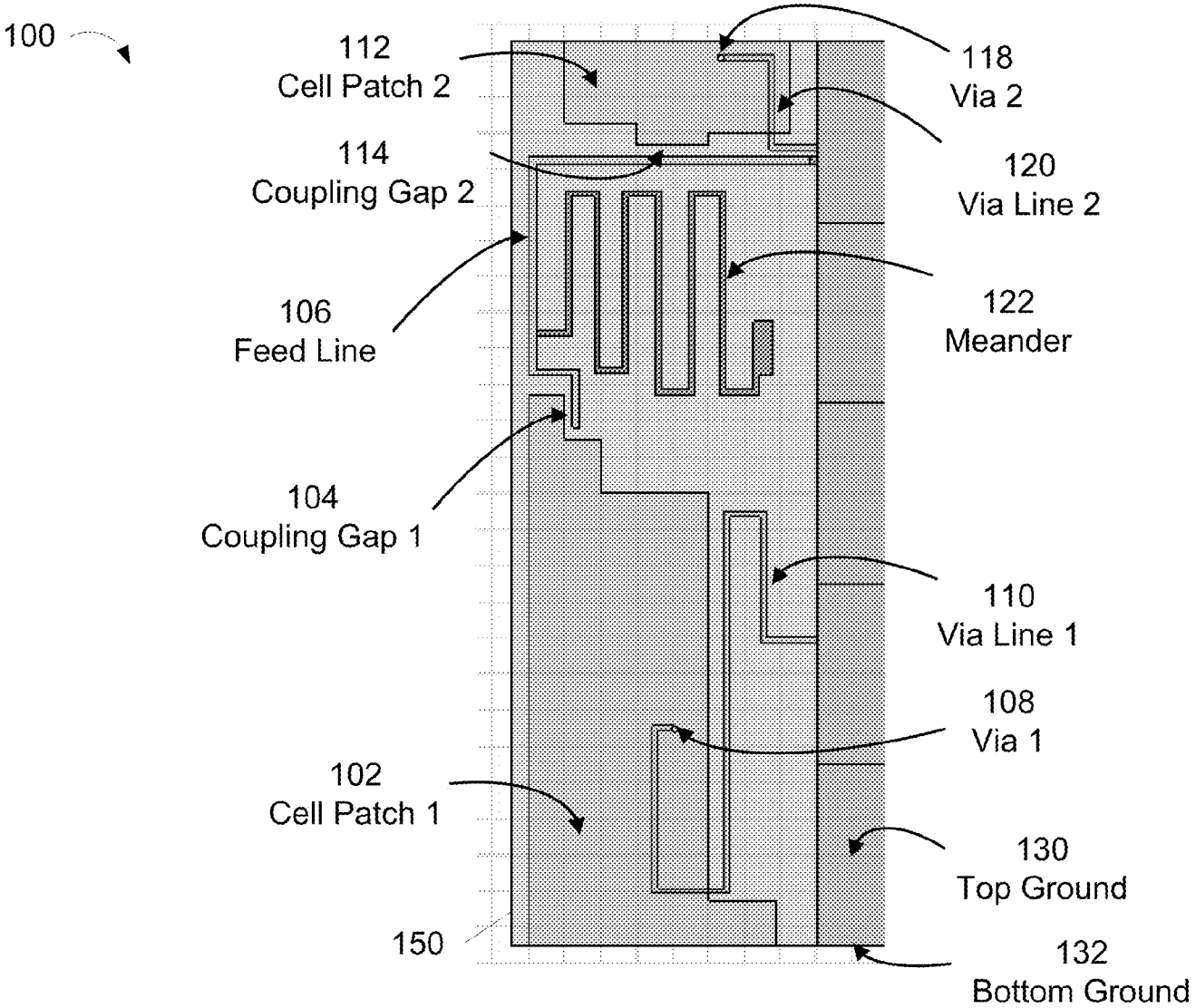
FIG. 1 is a block diagram illustrating an example of a wireless device with an antenna having a single feed structure and dual cell radiating elements.

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

In one embodiment, a wireless device has an antenna including a radiating element, a feed structure, a meander line and a conductive structure coupled to the feed line to extend a length of the meander line. The antenna further includes a metallic trace coupling the radiating element to a reference voltage.

A hybrid structure may be a printed CRLH antenna structure with a three dimensional (3-D) conductive bridge added to the meander line or replacing part of the meander line. An example embodiment has a printed portion of an antenna with a part of the proximal end portion of the meander is removed and a 3-D bridge is added to couple the remaining proximal portion, which is still attached to the feed line, and the distal end portion of the meander. Thus, the added 3-D bridge effectively increases the area and volume of the meander. The shape and size as well as positioning of the 3-D bridge maybe chosen differently based on tuning and matching considerations.

To better understand CRLH structures, consider that the propagation of electromagnetic waves in most materials obeys the right-hand rule for the (E,H,β) vector fields, considering the electrical field E, the magnetic field H, and the wave vector β (or propagation constant). The phase velocity direction is the same as the direction of the signal energy propagation (group velocity) and the refractive index is a positive number. Such materials are referred to as Right Handed (RH) materials. Most natural materials are RH materials. Artificial materials can also be RH materials.

A metamaterial has an artificial structure. When designed with a structural average unit cell size much smaller than the wavelength of the electromagnetic energy guided by the metamaterial, the metamaterial can behave like a homogeneous medium to the guided electromagnetic energy. Unlike RH materials, a metamaterial can exhibit a negative refractive index, and the phase velocity direction is opposite to the direction of the signal energy propagation, wherein the relative directions of the (E,H,β) vector fields follow the left-hand rule. Metamaterials which have a negative index of refraction with simultaneous negative permittivity $\in$ and permeability μ are referred to as pure Left Handed (LH) metamaterials.

Many metamaterials are mixtures of LH metamaterials and RH materials and thus are Composite Right and Left Handed (CRLH) metamaterials. A CRLH metamaterial can behave like an LH metamaterial at low frequencies and an RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials may be structured and engineered to exhibit electromagnetic properties tailored to specific applications and may be used in applications where it may be difficult, impractical or infeasible to use other materials. In addition, CRLH metamaterials may be used to develop new applications and to construct new devices that may not be possible with RH materials.

In some applications, CRLH structures and components are based on a technology which applies the concept of LH structures. As used herein, the terms "metamaterial," "MTM," "CRLH," and "CRLH MTM" refer to composite LH and RH structures engineered using conventional dielectric and conductive materials to produce unique electromagnetic properties, wherein such a composite unit cell is much smaller than the wavelength of the propagating electromagnetic waves.

Metamaterial (MTM) technology, as used herein, includes technical means, methods, devices, inventions and engineering works which allow compact devices composed of conductive and dielectric parts and are used to receive and transmit electromagnetic waves. Using MTM technology, antennas and RF components may be made compactly in comparison to competing methods and may be closely spaced to each other or to other nearby components while at the same time minimizing undesirable interference and electromagnetic coupling. Such antennas and RF components further exhibit useful and unique electromagnetic behavior that results from one or more of a variety of structures to design, integrate, and optimize antennas and RF components inside wireless communications devices.

CRLH structures are structures that behave as structures exhibiting simultaneous negative permittivity (∈) and negative permeability (μ) in a frequency range and simultaneous positive ∈ and positive μ in another frequency range. Transmission-line (TL) based CRLH structures are structures that enable TL propagation and behave as structures exhibiting simultaneous negative permittivity (∈) and negative permeability (μ) in a frequency range and simultaneous positive ∈ and positive μ in another frequency range. The CRLH based antennas and TLs may be designed and implemented with and without conventional RF design structures.

Antennas, RF components and other devices made of conventional conductive and dielectric parts may be referred to as "MTM antennas," "MTM components," and so forth, when they are designed to behave as an MTM structure. MTM components may be easily fabricated using conventional conductive and insulating materials and standard manufacturing technologies including but not limited to: printing, etching, and subtracting conductive layers on substrates such as FR4, ceramics, LTCC, MMIC, flexible films, plastic or even paper.

A CRLH structure has one or more CRLH unit cells. The equivalent circuit for a CRLH unit cell includes a right-handed series inductance LR, a right-handed shunt capacitance CR, a left-handed series capacitance CL, and a left-handed shunt inductance LL. The MTM-based components and devices can be designed based on these CRLH unit cells that can be implemented by using distributed circuit elements, lumped circuit elements or a combination of both. Unlike conventional antennas, the MTM antenna resonances are affected by the presence of the LH mode. In general, the LH mode helps excite and better match the low frequency resonances as well as improves the matching of high frequency resonances. The MTM antenna structures can be configured to support one or more frequency bands and a supported frequency band can include one or more antenna frequency resonances. For example, MTM antenna structures can be structured to support multiple frequency bands including a "low band" and a "high band." The low band includes at least one LH mode resonance and the high band includes at least one right-handed (RH) mode resonance associated with the antenna signal.

Some examples and implementations of MTM antenna structures are described in the U.S. patent application Ser. No. 11/741,674 entitled "Antennas, Devices and Systems Based on Metamaterial Structures," filed on Apr. 27, 2007; and the U.S. Pat. No. 7,592,957 entitled "Antennas Based on Metamaterial Structures," issued on Sep. 22, 2009. These MTM antenna structures can be fabricated by using a conventional FR-4 Printed Circuit Board (PCB) or a Flexible Printed Circuit (FPC) board. Examples of other fabrication techniques include thin film fabrication technique, system on chip (SOC) technique, low temperature co-fired ceramic (LTCC) technique, and monolithic microwave integrated circuit (MMIC) technique.

One type of MTM antenna structures is a Single-Layer Metallization (SLM) MTM antenna structure, which has conductive parts of the MTM structure in a single metallization layer formed on one side of a substrate. A Two-Layer Metallization Via-Less (TLM-VL) MTM antenna structure is of another type characterized by two metallization layers on two parallel surfaces of a substrate without having a conductive via to connect one conductive part in one metallization layer to another conductive part in the other metallization layer. The examples and implementations of the SLM and TLM-VL MTM antenna structures are described in the U.S. patent application Ser. No. 12/250,477 entitled "Single-Layer Metallization and Via-Less Metamaterial Structures," filed on Oct. 13, 2008.

In one implementation, an SLM MTM structure includes a substrate having a first substrate surface and an opposite substrate surface, a metallization layer formed on the first substrate surface and patterned to have two or more conductive parts to form the SLM MTM structure without a conductive via penetrating the dielectric substrate. The conductive parts in the metallization layer include a cell patch of the SLM MTM structure, a ground that is spatially separated from the cell patch, a via line that interconnects the ground and the cell patch, and a feed line that is capacitively coupled to the cell patch without being directly in contact with the cell patch. The LH series capacitance CL is generated by the capacitive coupling through the gap between the feed line and the cell patch. The RH series inductance LR is mainly generated in the feed line and the cell patch. There is no dielectric material vertically sandwiched between two conductive parts in this SLM MTM structure. As a result, the RH shunt capacitance CR of the SLM MTM structure can be made negligibly small by design. A relatively small RH shunt capacitance CR may be induced between the cell patch and the ground, both of which are in the single metallization layer. The LH shunt inductance LL in the SLM MTM structure may be negligible due to the absence of the via penetrating the substrate, but the via line connected to the ground may effectuate an inductance equivalent to the LH shunt inductance LL. An example of a TLM-VL MTM antenna structure can have the feed line and the cell patch in two different layers to generate vertical capacitive coupling.

Different from the SLM and TLM-VL MTM antenna structures, a multilayer MTM antenna structure has conductive parts in two or more metallization layers which are connected by at least one via. The examples and implementations of such multilayer MTM antenna structures are described in the U.S. patent application Ser. No. 12/270,410 entitled "Metamaterial Structures with Multilayer Metallization and Via," filed on Nov. 13, 2008. These multiple metallization layers are patterned to have multiple conductive parts based on a substrate, a film or a plate structure where two adjacent metallization layers are separated by an electrically insulating material (e.g., a dielectric material). Two or more substrates may be stacked together with or without a dielectric spacer to provide multiple surfaces for the multiple metallization layers to achieve certain technical features or advantages. Such multilayer MTM structures can have at least one conductive via to connect one conductive part in one metallization layer to another conductive part in another metallization layer.

An example of a double-layer MTM antenna structure with a via includes a substrate having a first substrate surface and a second substrate surface opposite to the first surface, a first metallization layer formed on the first substrate surface, and a second metallization layer formed on the second substrate surface, where the two metallization layers are patterned to have two or more conductive parts with at least one conductive via penetrating through the substrate to connect one conductive part in the first metallization layer to another conductive part in the second metallization layer. A truncated ground can be formed in the first metallization layer, leaving part of the surface exposed. The conductive parts in the second metallization layer can include a cell patch of the CRLH structure and a feed line, the distal end of which is located close to and capacitively coupled to the cell patch to transmit an antenna signal to and from the cell patch. The cell patch is formed in parallel with at least a portion of the exposed surface. The conductive parts in the first metallization layer include a via line that connects the truncated ground in the first metallization layer and the cell patch in the second metallization layer through a via formed in the substrate. The LH series capacitance CL is generated by the capacitive coupling through the gap between the feed line and the cell patch. The RH series inductance LR is mainly generated in the feed line and the cell patch. The LH shunt inductance LL is mainly induced by the via and the via line. The RH shunt capacitance CR may be primarily contributed by a capacitance between the cell patch in the second metallization layer and a portion of the via line in the footprint of the cell patch projected onto the first metallization layer. An additional conductive line, such as a meander line, can be attached to the feed line to induce an RH monopole resonance to support a broadband or multiband antenna operation.

A CRLH structure can be specifically tailored to comply with requirements of a particular application, such as PCB real-estate factors, device performance requirements and other specifications. The cell patch in the CRLH structure can have a variety of geometrical shapes and dimensions, including, for example, rectangular, polygonal, irregular, circular, oval, or combinations of different shapes. The via line and the feed line can also have a variety of geometrical shapes and dimensions, including, for example, rectangular, polygonal, irregular, zigzag, spiral, meander or combinations of different shapes. The distal end of the feed line can be modified to form a launch pad to modify the capacitive coupling. The launch pad can have a variety of geometrical shapes and dimensions, including, e.g., rectangular, polygonal, irregular, circular, oval, or combinations of different shapes. The gap between the launch pad and cell patch can take a variety of forms, including, for example, straight line, curved line, L-shaped line, zigzag line, discontinuous line, enclosing line, or combinations of different forms. Some of the feed line, launch pad, cell patch and via line can be formed in different layers from the others. Some of the feed line, launch pad, cell patch and via line can be extended from one metallization layer to a different metallization layer. The antenna portion can be placed a few millimeters above the main substrate. Multiple cells may be cascaded in series to form a multi-cell 1D structure. Multiple cells may be cascaded in orthogonal directions to form a 2D structure. In some implementations, a single feed line may be configured to deliver power to multiple cell patches. In other implementations, an additional conductive line may be added to the feed line or launch pad in which this additional conductive line can have a variety of geometrical shapes and dimensions, including, for example, rectangular, irregular, zigzag, planar spiral, vertical spiral, meander, or combinations of different shapes. The additional conductive line can be placed in the top, mid or bottom layer, or a few millimeters above the substrate. In addition, non-planar (three-dimensional) MTM antenna structures can be realized based on a multi-substrate structure. The examples and implementations of such multi-substrate-based MTM structures are described in the U.S. patent application Ser. No. 12/465,571 entitled "Non-Planar Metamaterial Antenna Structures," filed on May 13, 2009.

Antenna efficiency is one of the important performance metrics especially for a compact mobile communication device where the PCB real-estate is limited. In general, an antenna size and efficiency have a trade-off relationship, in that the decrease in antenna size can cause the efficiency to decrease. Thus, obtaining a high efficiency with a given limited space can pose a challenge in antenna designs especially for applications in cell phones and other compact mobile communication devices. This document describes a hybrid antenna structure in which a three-dimensional (3D) conductive bridge, block or strip is added to a printed antenna structure so as to effectively increase the conductive area and volume of the antenna, thereby increasing the efficiency.

FIG. 1 illustrates a CRLH antenna structure 100 printed on a dielectric substrate 150, such as an FR-4. In the present embodiment the CRLH antenna structure 100 is printed onto a Printed Circuit Board (PCB) using a conductive material or metallization. Alternate embodiments may use any of a variety of materials are dielectric or act as a dielectric, including paper and cloth. Top and bottom metallization layers are formed on the top and bottom surfaces of the substrate 150, respectively, and are shown as overlapped in this figure. This structure is an example of a double-layer CRLH antenna structure mentioned above as having two metallization layers. A cell patch 1102 and a cell patch 2 112 are formed in the top layer of substrate 150. A feed line 106 is also formed in the top layer. One end of the feed line 106 may be coupled to a feed port (not shown) in the top ground through a coplanar waveguide (CPW) feed line (not shown), for example, which is in communication with an antenna circuit such as including CRLH antenna structure 100, that generates and supplies an antenna signal to be transmitted out through the antenna, or receives and processes an antenna signal received through the antenna. Two portions of the feed line 106 are capacitively coupled to the cell patch 1102 and cell patch 2 112 through coupling gap 1104 and coupling gap 2 114, respectively, to direct the antenna signal to and from the cell patches land 2, thus providing a single-feed dual-cell configuration. In other words, the single feed line 104 is used to feed both cell patches, dual cell. Via 1108 and via 2 118 refer to the conductive material in the respective via holes which provide conductive connections between cell patches, cell patch 1102 and cell patch 2112, in the top layer and via lines, via line 1110 and via line 2 120, in the bottom layer, respectively.

In this example, a conductive meander line 122 is formed in the top layer and attached to the feed line. The meander line 122 is a metallization layer printed on the substrate 150. The meander line 122 is an additional conductive line. In the present embodiment, the meander line is a linear structure which is configured in available space on the substrate 150. Other embodiments may implement a different shape or design, such as a spiral line, a zigzag line or other type of lines, curves, shapes or strips may be used. The feed line 106 and the meander 122 may be connected in a variety of ways to achieve a variety of different total lengths.

Each of the via lines 1 and 2 is coupled to a bottom ground 132, which is formed on the bottom layer and provides a reference voltage. Note, the use of top layer and bottom layer is for reference only, and there is not necessarily a significance in which is referred to as top or bottom. In this printed structure 100, the via lines 1 and 2 and the bottom ground 132 are formed in the bottom layer, the vias 1 and 2 are formed in the substrate 150 going from the top layer to the bottom layer through the dielectric material, and other conductive parts are formed in the top layer 130.

The shape of the cell patch 1 102 and cell patch 2 112 are designed to achieve specific frequency ranges. Other designs may be incorporated to have a capacitive coupling between the feed line and the cell patches and an inductive loading from the cell patches to ground so as to achieve a similar result. Additionally, other frequency ranges may be achieved with different shape and placement of the various structures. The CRLH structure 100 induces both RH resonance modes and LH resonance modes.

Figure 2:
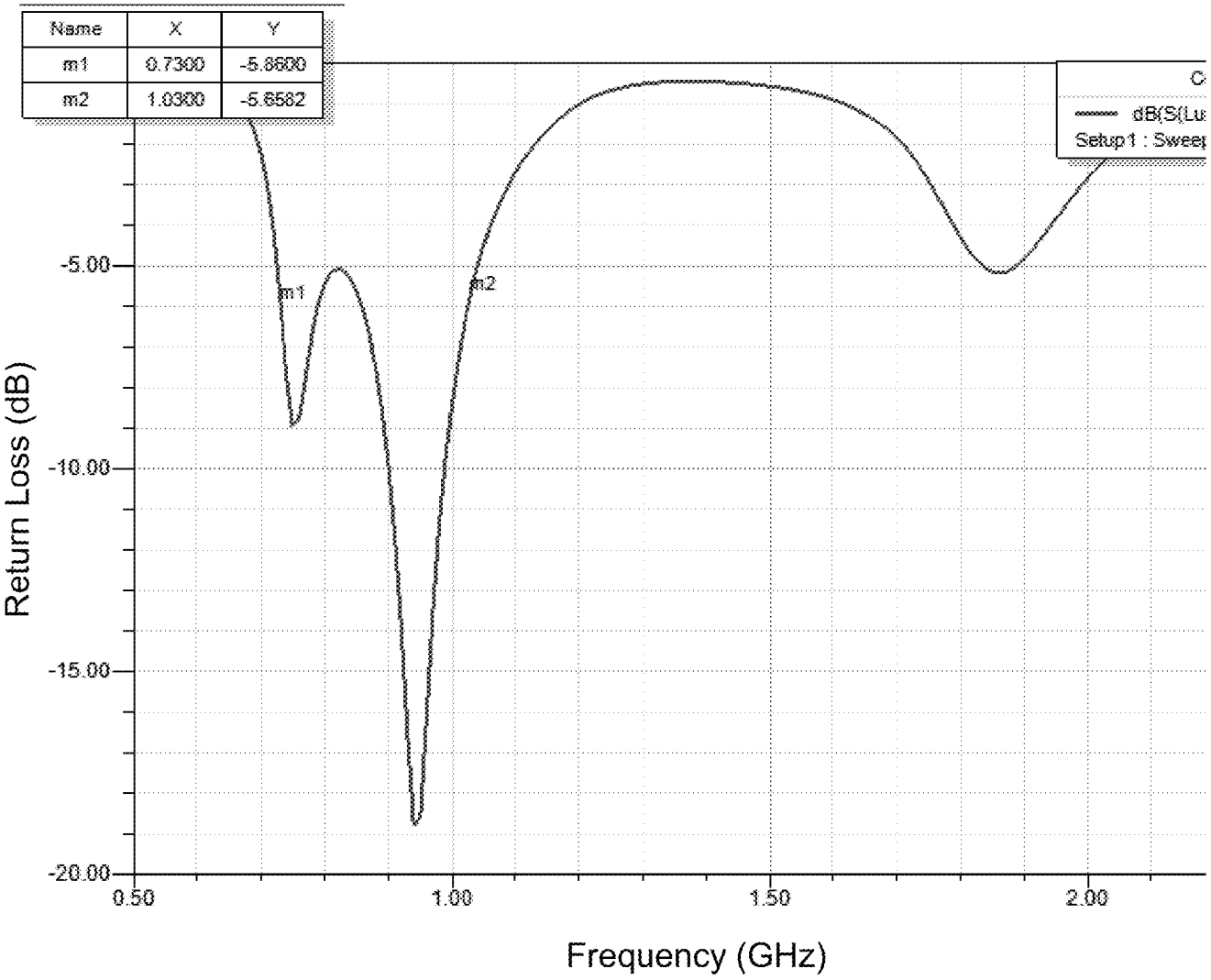
FIG. 2 is a graph of return loss as a function of frequency for a wireless device as in FIG. 1.

FIG. 2 plots the simulation results of return loss of an example of the printed CRLH antenna structure 100 illustrated in FIG. 1. Due to the meander line 122 attached to the feed line 106, the low frequency RH monopole resonance (hereinafter a "meander mode") is observed near 940 MHz. The LH resonance is observed at 750 MHz, and a RH resonance high frequency is observed at approximately 1.85 GHz. Therefore, the single-feed dual-cell design results in three resonant frequencies, which may be positioned and adjusted by modification of the structure size, shape and placement on the substrate 150.

Figure 3:
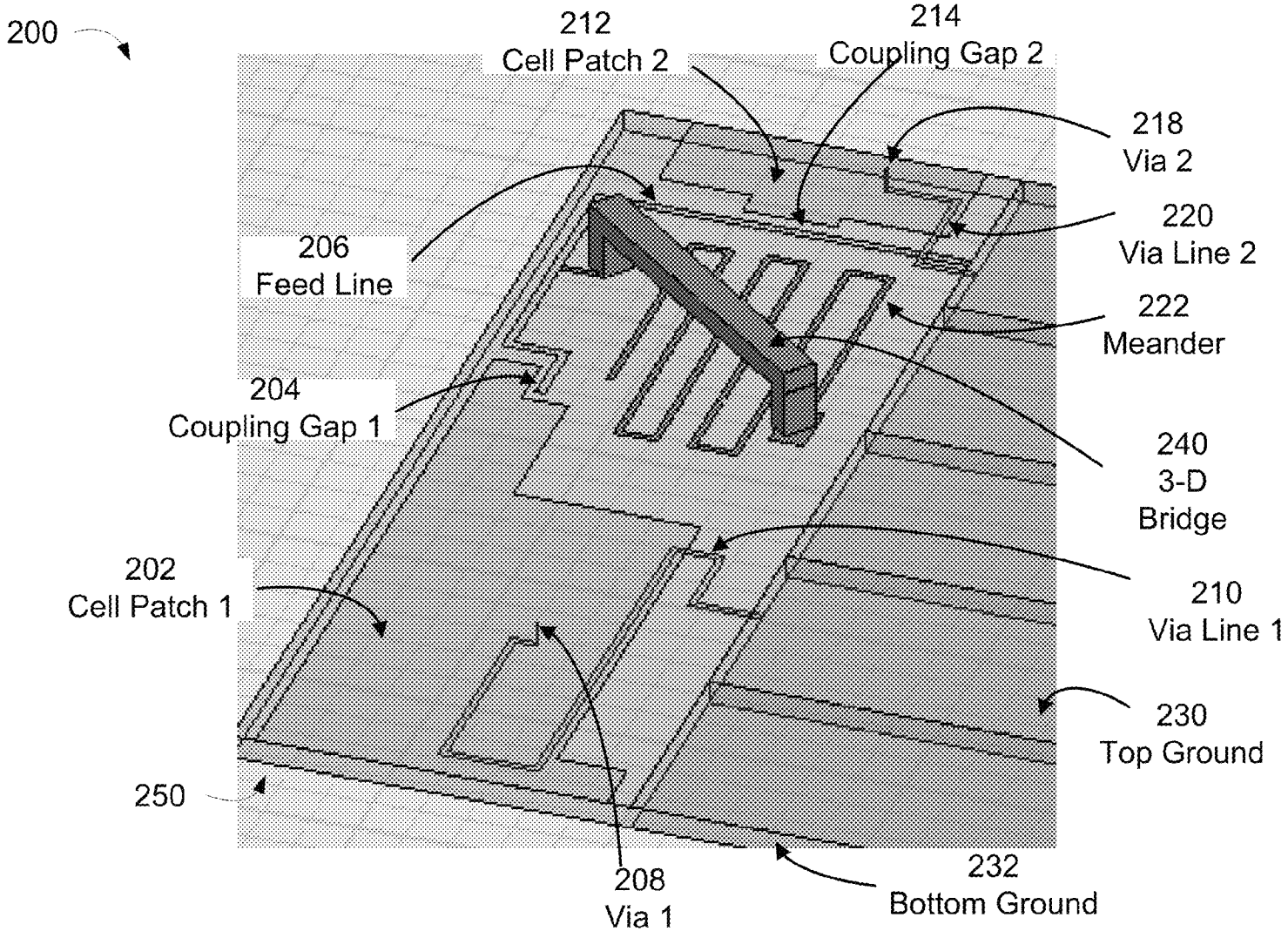
FIG. 3 is a block diagram illustrating a wireless device having an antenna as in FIG. 1 and a conductive structure coupled to a meander line, according to an example embodiment.

FIG. 3 illustrates an example of a hybrid antenna structure 200. This hybrid structure 200 may be viewed as the printed CRLH antenna structure with a 3-D conductive bridge replacing part of the meander line. The printed portion of the antenna is similar to the structures of FIG. 1, having cell patch 1 202, cell patch 2 212, in configuration with a single feed line 206. The structure 200 includes via 1 208 coupling cell patch 1 202 to via line 1 210, and includes via 2 218 coupling cell patch 2 212 to via line 2 220. The feed line 206 is coupled to a meander 222. In this embodiment, a 3-D bridge structure 240 is coupled to the meander 222. In this example, the 3-D bridge 240 is added to couple one portion of the meander 222, which is attached to the feed line 206, to another portion of the meander. Thus, the added 3D bridge effectively increases the area and volume of the meander. The shape and size as well as positioning of the 3-D bridge may be designed in a variety of ways to achieve antenna frequency tuning and matching specifications. This embodiment is a multi-layer design having a top layer and a bottom layer, a top ground 230 and a bottom ground 232. The single feed line 206 is capacitively coupled to cell patch 1 202 at a first position and capacitively coupled to cell patch 2 212 as a second position. The addition of the bridge 240 acts to shift a meander mode frequency, and in this case, shift the meander mode frequency to a lower frequency.

Figure 4:
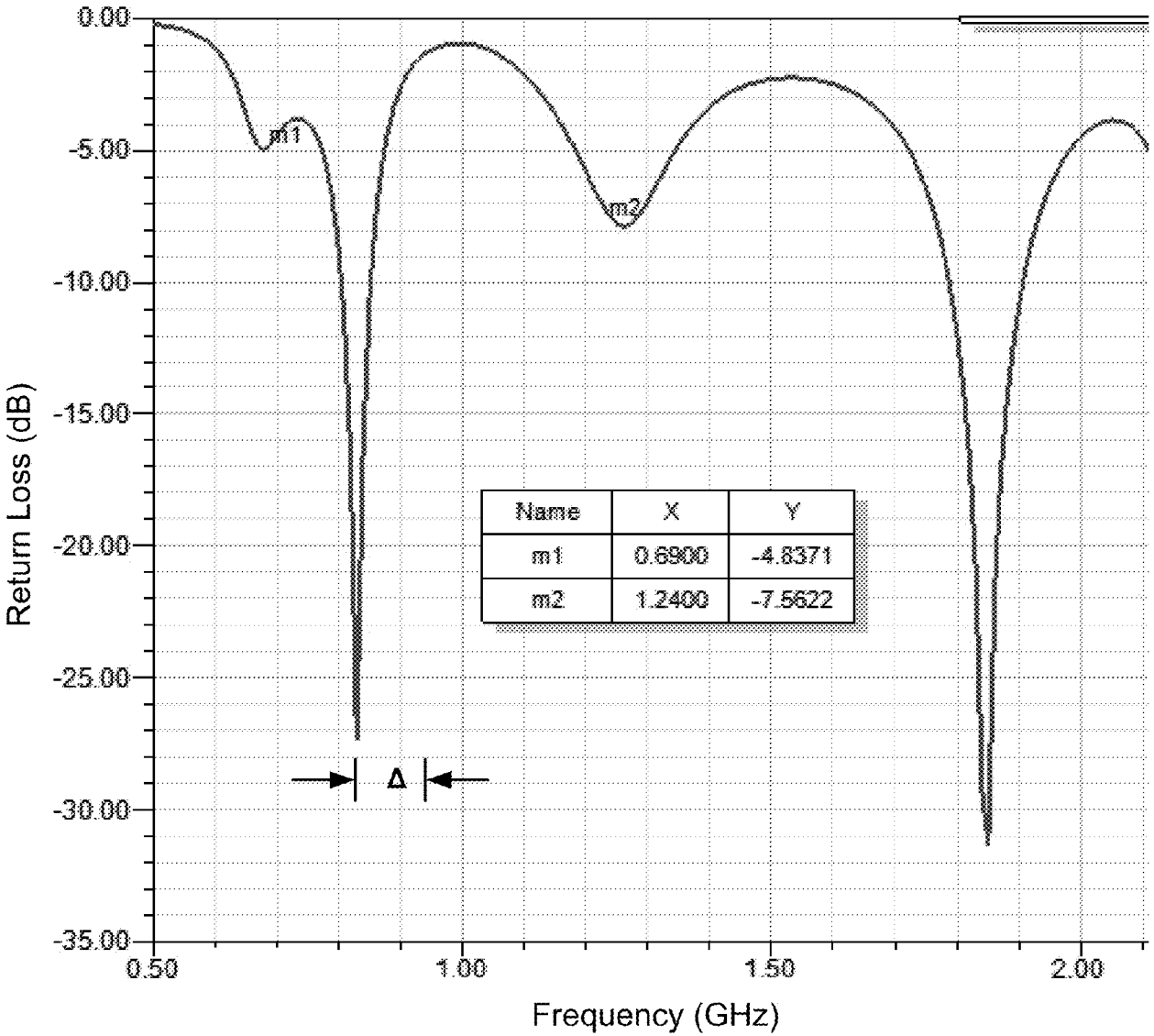
FIG. 4 is a graph of return loss as a function of frequency for a wireless device as in FIG. 3.

FIG. 4 plots simulation results of return loss of an example of a hybrid CRLH antenna structure as structure 200 illustrated in FIG. 3. The dimensions of the 3-D bridge for one example are 1.5 mm in width, 15 mm in length and 2 mm in height. As the bridge 240 increases the area and volume of the "effective meander structure," a meander mode resonance frequency is shifted to the lower frequency at about 820 MHz in this example. Alternate embodiments may have various structures and sizes to adjust the meander mode frequency to specifications. The difference, Δ, identifies the shift.

Figure 5:
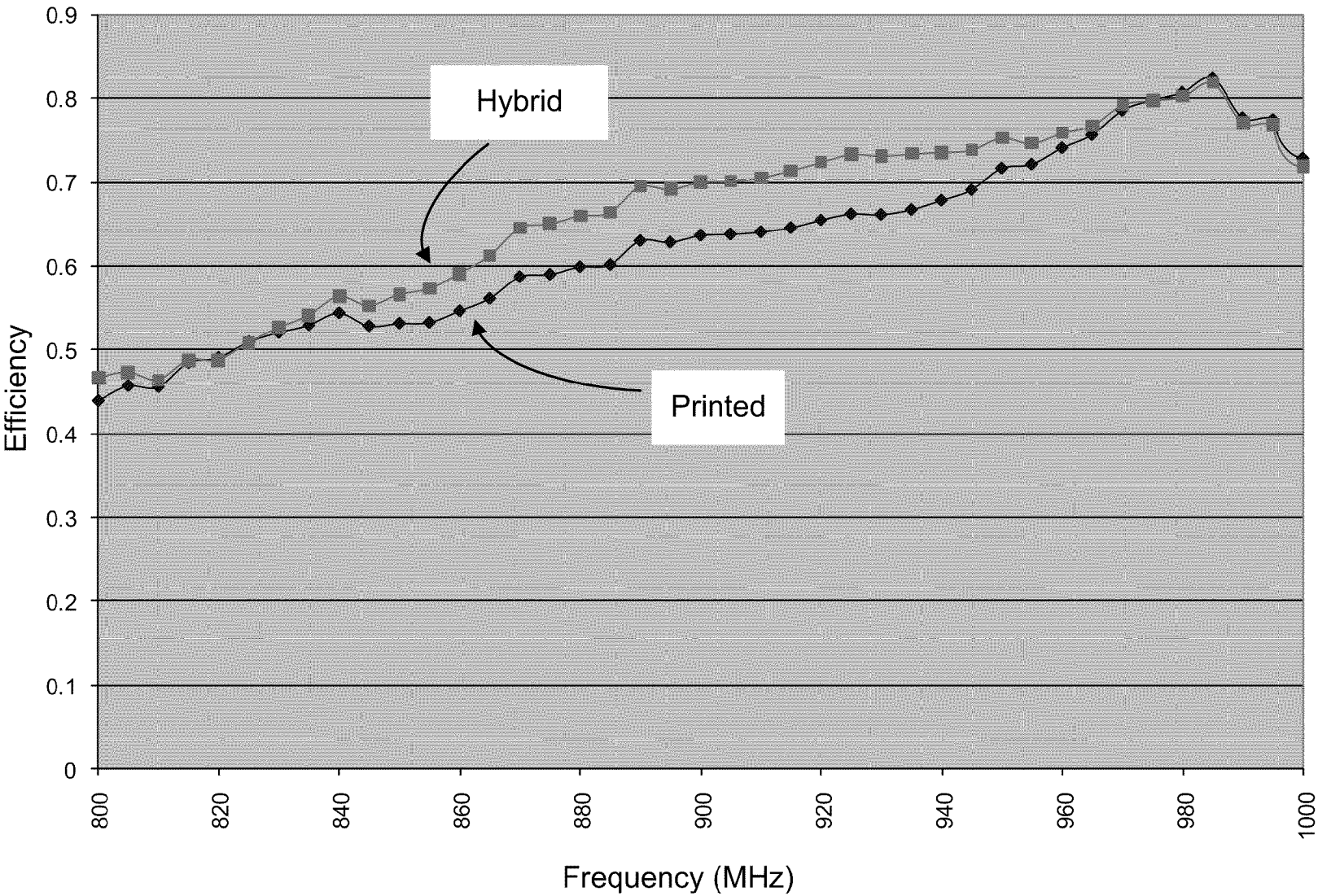
FIG. 5 is a graph of efficiency as a function of frequency for a wireless device as in FIG. 3.

FIG. 5 plots the simulation results of efficiency of an embodiment of a printed CRLH antenna structure 100 and the hybrid CRLH antenna structure 200 illustrated in FIGS. 1 and 3, respectively. For the comparison, the studied antenna structures are tuned to the same bands. Due to the increased area and volume of the effective meander including the 3-D bridge 240, the efficiency of the hybrid antenna is improved compared to the printed antenna especially in the low frequency region where the meander mode is dominant. Such structure is particularly beneficial with CRLH structures, as the structures are typically printed in the available area, having amorphous and irregular shapes. The use of a 3-D structure to expand area and volume allows enhanced design and performance without impacting the overall size of the wireless device.

A similar technique may be utilized to increase or adjust the area and volume of other parts of the antenna structure by adding a 3-D conductive bridge, block, strip, and the like. For example, a portion of a via line may be removed so as to attach a 3-D conductive bridge between the edge portions of the remaining via line to couple the 3-D bridge to the via line, thereby effectively increasing the area and volume of the via line including the 3-D bridge. This addition may affect an LH shunt inductance, LL or $L_L$, associated with a via line, providing flexibility for antenna tuning and matching. In another example, a 3-D conductive strip may be added to the cell patch to effectively increase the area and volume of the cell patch for better radiation and efficiency. Furthermore, when electronic components such as microphones, speakers, key domes, etc., are collocated on the same PCB, a 3-D conductive bridge, block, strip and the like may be used to go over or around such a component to couple between two parts of the printed antenna, thereby saving space and at the same time improving efficiency.

While this specification contains many specifics, these should not be construed as limitations on the scope of an invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or a variation of a subcombination. Only a few implementations are disclosed. However, it is understood that variations and enhancements may be made.

The invention claimed is:

1. A wireless device having a Composite Right and Left Handed (CRLH) antenna structure, comprising:

a substrate including at least planar metallization layer comprising:

a cell patch;

a feed line capacitively coupled to the cell patch;

a meander line coupled to the feed line; and a conductive line coupling the cell patch to a reference voltage; and a conductive structure coupled to the feed line, configured to extend in three dimensions including outside a plane of the metallization layer, the conductive structure configured to bridge a first location to a second location on the meander line and configured to increase an effective length of the meander line, wherein the meander line and the conductive structure are configured to provide a first right-handed (RH) mode resonance established by the effective length of the meander line; and wherein the cell patch and the conductive line are configured provide a left-handed (LH) mode resonance.

2. The wireless device as in claim 1, wherein the feed line is position proximate the cell patch with a coupling gap therebetween providing a capacitance.

3. The wireless device as in claim 2, wherein the conductive line provides an inductance and wherein the capacitance and the inductance provide the LH mode resonance.

4. The wireless device as in claim 1, wherein the first RH mode resonance comprises meander mode resonance frequency, and wherein the conductive structure is configured to shift the meander mode resonance frequency to a lower frequency.

5. The wireless device as in claim 4, wherein the conductive structure is configured to increase an effective volume of the meander line.

6. The wireless device as in claim 4 wherein the antenna structure supports a second RH mode resonance having a frequency higher than a frequency of the meander mode resonance.

7. The wireless device as in claim 1, wherein the substrate and the at least one metallization layer are included as a portion of a Printed Circuit Board.

8. The wireless device as in claim 1, further comprising a second cell patch capacitively coupled to the feed structure.

9. A method for forming a Composite Right and Left Handed (CRLH) antenna structure, comprising:

forming a first planar metallization layer on a substrate, the first metallization layer comprising:

a cell patch;

a feed line capacitively coupled to the cell patch; and a meander line coupled to the feed line;

forming a conductive structure coupled to the feed line, configured to extend in three dimensions including outside respective planes of the metallization layers, and configured to increase an effective length of the meander line; and forming a second planar metallization layer on the substrate, the second metallization layer comprising a conductive line adapted to couple the cell patch to a reference voltage, wherein the meander line and the conductive structure are configured to provide a first right-handed (RH) mode resonance established by the effective length of the meander line;

wherein the cell patch and the conductive line are configured provide a left-handed (LH) mode resonance; and wherein the conductive structure is a bridge structure coupling one part of the meander line to another part of the meander line.

10. The method as in claim 9, further comprising:

forming at least one via through the substrate having a conductive material filling the at least one via, wherein the at least one via couples the cell patch to the conductive line.

11. The method as in claim 9, wherein the conductive structure is coupled to the first metallization layer, but extends out of the first metallization layer.

12. The method as in claim 11, wherein forming the first metallization layer comprises forming a second cell patch in the first metallization layer, wherein the feed structure is capacitively coupled to the second cell patch.

13. The method as in claim 9, wherein the first and second metallization layers are formed on a dielectric substrate.

14. The method as in claim 13, wherein forming the second metallization layer comprises forming a ground electrode on the substrate.

15. The wireless device as in claim 1, wherein the cell patch is located on a first metallization layer, and wherein the conductive line is configured to couple the cell patch to a ground electrode located on a second metallization layer.

16. The wireless device as in claim 15, wherein the ground electrode is located outside a footprint of the cell patch projected from the first metallization layer to the second metallization layer.

17. The method as in claim 14, wherein the ground electrode is located outside a footprint of the cell patch projected from the first metallization layer to the second metallization layer.

* * * * *